US011713214B2

(12) United States Patent
Cook

(10) Patent No.: US 11,713,214 B2
(45) Date of Patent: Aug. 1, 2023

(54) STAIRLIFTS

(71) Applicant: Stannah Stairlifts Limited, Hampshire (GB)

(72) Inventor: Paul Alexander Cook, Shrewton (GB)

(73) Assignee: Stannah Stairlifts Limited

( * ) Notice: Subject to any disclaimer, the term of this patent is extended or adjusted under 35 U.S.C. 154(b) by 0 days.

(21) Appl. No.: 17/625,802

(22) PCT Filed: Jul. 7, 2020

(86) PCT No.: PCT/GB2020/051626
§ 371 (c)(1),
(2) Date: Jan. 10, 2022

(87) PCT Pub. No.: WO2021/005354
PCT Pub. Date: Jan. 14, 2021

(65) Prior Publication Data

US 2022/0259010 A1 Aug. 18, 2022

(30) Foreign Application Priority Data

Jul. 9, 2019 (GB) ..... 1909847

(51) Int. Cl.
*B66B 9/08* (2006.01)

(52) U.S. Cl.
CPC ..... *B66B 9/0807* (2013.01)

(58) Field of Classification Search
CPC ..... B66B 9/0807; B66B 9/0853
See application file for complete search history.

(56) References Cited

U.S. PATENT DOCUMENTS

2010/0314201 A1 12/2010 Stannah et al.

FOREIGN PATENT DOCUMENTS

| | | | | | |
|---|---|---|---|---|---|
| CN | 104816998 | A | | 8/2015 | |
| CN | 204847682 | U | | 12/2015 | |
| GB | 2367808 | A | | 4/2002 | |
| GB | 2435463 | A | * | 8/2007 | ..... B66B 9/08 |
| GB | 2435463 | A | | 8/2007 | |
| GB | 2543772 | A | * | 5/2017 | ..... A47C 7/50 |
| JP | 2008100788 | A | | 5/2008 | |

OTHER PUBLICATIONS

International Search Report dated Oct. 22, 2020; International Application PCT/GB2020/051626.
UK Search Report dated Dec. 24, 2019, International Application GB1909847.4.

* cited by examiner

*Primary Examiner* — Jeffrey Donels
(74) *Attorney, Agent, or Firm* — Dinsmore & Shohl LLP

(57) ABSTRACT

A footrest safety pad arrangement is incorporated in a stairlift carriage in which movement of a safety pad relative to the carriage is sensed by an electromagnetic sensor and a control signal applied to the stairlift drive motor.

7 Claims, 4 Drawing Sheets

STAIRLIFTS

CROSS-REFERENCE TO RELATED APPLICATIONS

This application is the U.S. National Stage of PCT/GB2020/051626 filed Jul. 7, 2020, which claims priority to United Kingdom Patent Application No. 1909847.4 filed Jul. 9, 2019, the content of both of which are incorporated herein by reference in their entirety.

FIELD OF THE INVENTION

This invention relates to stairlifts and in particular to a method of and/or means for, implementing part of a safety system for a stairlift.

BACKGROUND TO THE INVENTION

A stairlift is required, by regulation, to include safety devices positioned to be contacted by obstructions on a staircase, which serve to bring the stairlift carriage to a halt in the event the carriage contacts the obstruction. It is known to provide such devices in the form of moveable pads incorporated in the stairlift carriage and, in particular but not necessarily solely, in the footrest of the stairlift chair. One or more pads (often referred to as safety edges) are typically provided, arranged to detect obstructions during both uphill and downhill travel of the carriage.

There is also a requirement to detect which pad is actuated, or the direction in which the carriage is moving when a pad is actuated, so that the carriage can be backed away from an obstruction. In other words, if the carriage engages an obstruction on the staircase whilst moving down the staircase, a subsequent call to keep the carriage moving downwards will be declined. However, if a call is made to move the carriage in the opposite direction, the call will be activated and the carriage will be allowed to move in the upward direction away from the obstruction. No further downward movement will be allowed unless and until the pad circuit, originally opened on engagement with the obstruction, is again closed. This typically means that the stairlift controller is configured to respond either to a safety pad on the uphill side of the carriage, or the safety pad on the downhill side of the carriage, depending on the direction of movement of the carriage; but not to both at the same time. This gives rise to a potential problem which cannot be addressed using the present arrangement of mechanical linkages and switches. As a stairlift carriage moves through an outside bend in a rail and swivels about a vertical axis, if the axis of rotation of the chair is within the plan footprint of the chair, a part of the trailing edge of the carriage/chair combination effectively becomes the leading edge and thus a downhill safety pad becomes an uphill safety pad for the duration of travel through the outside bend. However, since the safety pad on the trailing edge is not then responsive, if an obstruction is encountered in the course of the swivelling movement, the carriage will not be halted. As a result, harm to person or property could arise.

As stairlifts are mounted at steeper angles or, as described in our European Patent 1 720 790, the rail includes a vertical section, the possibility exists that the carriage will bear down on an obstruction in a substantially vertical direction; and that one of the directional safety pads will not be actuated. This particular problem is addressed in our British Patent No. 2 435 463 which describes a combination of mechanical linkages and switches that allow obstructions arising in a variety of directions to be detected and the carriage brought to a halt. Whilst the described arrangement has proved to be effective, it still experiences 'dead zones' in the detection of obstructions, is costly to implement and the multiplicity of linkages and switches give rise to potential reliability problems.

It is an object of this invention to provide a method of, and means for, which will go at least some way in addressing the concern expressed above; or which will at least provide a novel and useful choice.

SUMMARY OF THE INVENTION

Accordingly, in one aspect, the invention provides a stairlift including a carriage; at least one safety edge mounted on said carriage but displaceable with respect to said carriage; and an electro-magnetic sensing facility configured to sense displacement of said safety edge relative to said carriage.

Preferably said at least one safety edge is incorporated in a footrest mounted on or forming part of said carriage.

Preferably a plurality of safety edges are provided and wherein a single electro-magnetic sensing facility is configured to sense displacement of each safety edge.

Preferably said plurality of safety edges are defined in or on a common member.

Preferably said electro-magnetic sensing facility is configured to determine direction of displacement of said safety edge relative to said carriage.

Preferably said electro-magnetic sensing facility includes a Hall effect sensor and a permanent magnet the construction and arrangement being such that displaceable of a safety edge relative to said foot support effects relative displacement between said Hall effect sensor and said magnet.

Preferably said stairlift further includes a drive motor and a control system, wherein said control system is configured to receive signals from said electro-magnetic sensing facility and, in response thereto, apply a control to said drive motor.

Many variations in the way the present invention can be performed will present themselves to those skilled in the art. The description which follows describes one example only of combinations of elements or components for performing the invention. Within the limits of the appended claims one, more or all of the described elements could be substituted to provide an embodiment of the invention and the invention is not to be confined to the combinations, whether in whole or in part, to those described.

BRIEF DESCRIPTION OF THE DRAWINGS

One operating embodiment of the invention will now be described with reference to the accompanying drawings in which.

DETAILED DESCRIPTION OF WORKING EMBODIMENT

Figure 1:
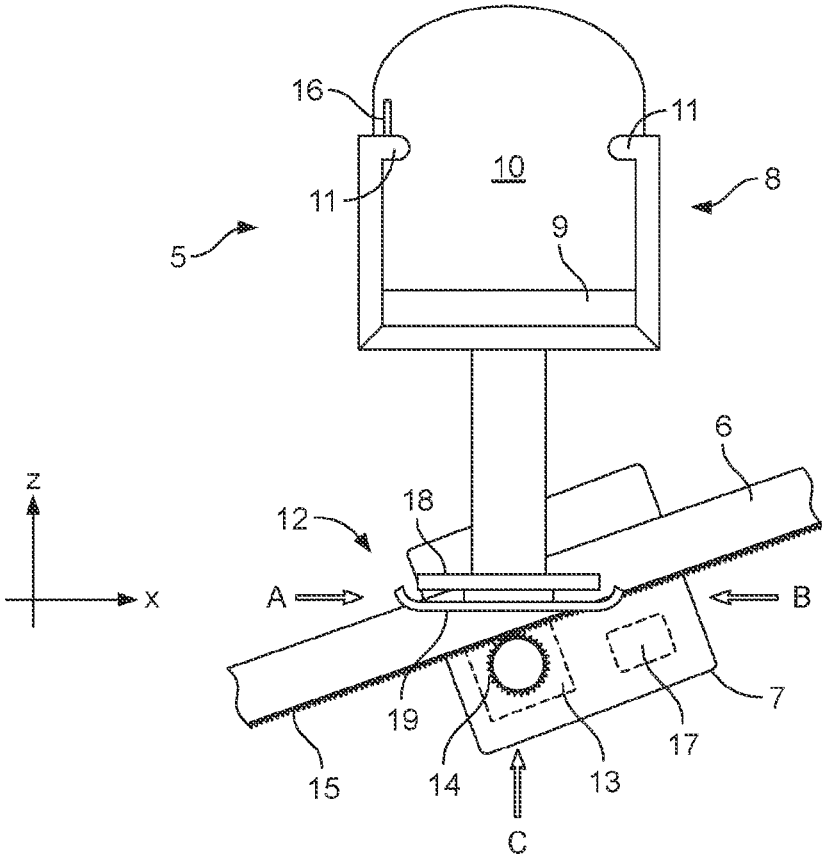
FIG. 1: shows a schematic front elevation of a typical stairlift incorporating the invention.

With reference to FIG. 1, the invention provides part of a safety system for a stairlift installation 5, the installation 5 including a rail 6, a carriage 7 mounted on the rail for movement along the rail, and a chair 8 mounted on the carriage.

In the conventional manner, the chair 8 comprises a seat base 9, a backrest 10, two armrests 11 and a footrest 12.

Included within the carriage is a drive motor 13 on the output of which is a pinion 14 engaging with a rack 15 extending along the underside of the rail 6. Control of the motor is effected by means of a hand control 16 mounted on one of the armrests 11, and an electronic control unit 17.

It is to be emphasised that the arrangement described above is by way of example and other configurations and other drive arrangements may be provided without departing from the scope of the invention.

Conventionally, as part of a system provided to ensure passenger safety, safety pads or edges are provided on the carriage, and in particular the footrest 12 so that, in the event the stairlift encounters an obstruction during travel, a safety edge will be displaced, activate a switch connected to the control unit 17, and cause the carriage to come to a halt. An example of safety edges included in a footrest is described in UK Patent No. GB 2 435 463. In this patent the safety edges are included in a single tray-like member fixed to the underside of the foot support part of the footrest but in a manner that allows the tray-like member to be displaced both laterally and vertically with respect to the footrest, and in directions which are combinations of lateral and vertical movement. While in the embodiment of the present invention described herein, an arrangement of foot support 18 and under-tray 19 is proposed, those skilled in the art will appreciate that the principles of the invention may equally be applied to arrangements in which individual safety edges, both on the footrest and elsewhere, are provided to address obstructions encountered in different directions.

The under-tray 19 may be mounted to the foot support 18 in any manner that allows the under-tray to move laterally with respect to the foot support i.e. along the x axis in FIG. 1 in the direction of arrow A and arrow B. As will become apparent from the description that follows, the mounting arrangement preferably also allows the under-tray to move vertically upwards with respect to the foot support i.e. along the z axis in FIG. 1 and in the direction of arrow C; and to rotate, at least to a limited extent, with respect to the foot support i.e. about the z axis. Combinations of movements along the x, y, and z axes can also be accommodated.

Figure 2:
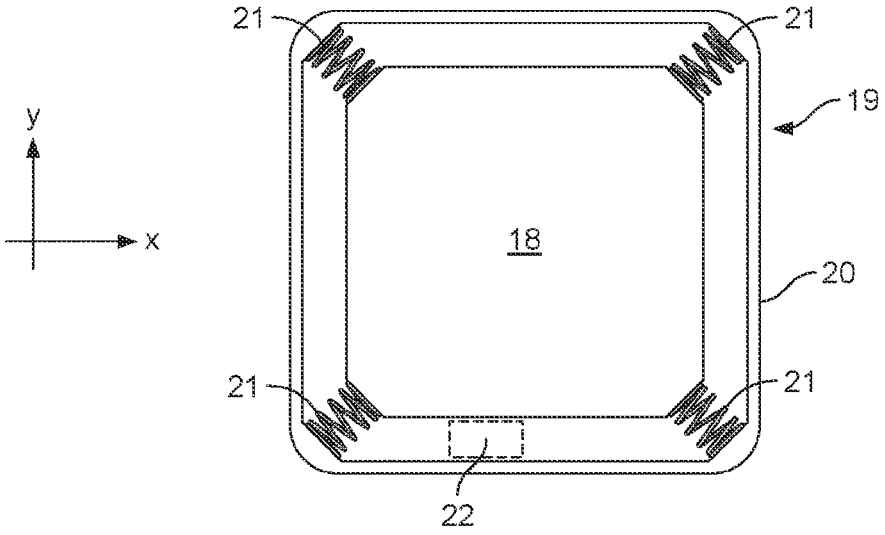
FIG. 2: shows a plan, sectional, view of a footrest assembly suitable for incorporating the invention.

In the illustrated example, these ranges of movement are accommodated by configuring both the support 18 and the tray 19 with similar shapes when viewed in plan, in this case as rectangular members, and further configuring the tray so that the outer periphery 20 extends up to overlie the edges of the foot support 18 as can be seen most clearly in FIGS. 3A-3F. In this way the tray, which may be a relatively light plastics moulding, can be fixed to the support 18 by means of coil springs 21 extending, as shown in FIG. 2, between the corner apices of the support 18 and the corresponding inner corner apices of the tray 19. Given that there is no movement along the y axis shown in FIG. 2, whether the footrest is in the operating state shown in FIG. 1 or the folded states, one or more stops 22 may be inserted between the tray and the foot support in this direction.

Figure 3A:
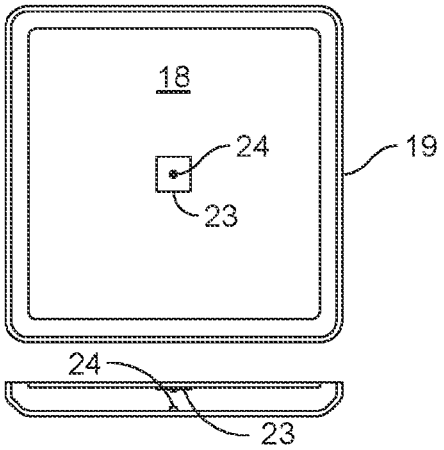
FIGS. 3A to 3F: show schematic plan views, and corresponding sectional side views, of a stairlift chair footrest according to the invention in several different states.

Each of the springs 21 should be under a similar degree of compression so that the tray is retained in a neutral position as shown in FIGS. 2 & 3A and the tray is restrained in all three x, y and z directions by the springs from falling vertically down.

The heart of the present invention lies in the use of an electromagnetic sensing facility to sense movements of the tray 19 relative to the foot support 18 and to relay signals representative of those movements to the control unit 17. As will be described in greater detail below, the control unit 17 is programmed to interpret the signals and apply the appropriate control over the drive motor 13 in light of the particular signal. In this way the complex linkages and switches of prior art footrest assemblies can be eliminated.

While the benefits of the invention could be achieved by a plurality of electromagnetic sensors, the combination of foot support 18 and tray 19 as described above lends itself to the use of a single electromagnetic sensing facility. This facility preferably comprises a Hall-effect sensor on one of the components 18 or 19, and a permanent magnet on the other. In the embodiment depicted, Hall-effect sensor 23 is shown mounted substantially centrally on the underside of foot support 18 while the magnet 24 is shown mounted on the inner surface of tray 19. The Hall-effect sensor may, by way of example only, be a 3D Hall-effect sensor such as a Melexis MLX90393 TRIAXIS® magnetic field sensor manufactured by Melexis NV, Ypres, Belgium. This sensor may be used in combination with a single magnetic disc, for example a 6 mm×3 mm Neodymium magnetic disc.

The system needs to be calibrated for a specific gap between the sensor 23 and the magnet 24 but the actual gap dimension is essentially arbitrary, a limitation being that the sensor needs to be able to measure a non-zero magnetic field intensity at any point. Thus, the gap could be increased if the sensitivity of the sensor were to increase or if the strength of the magnet were to increase.

Figure 3B:
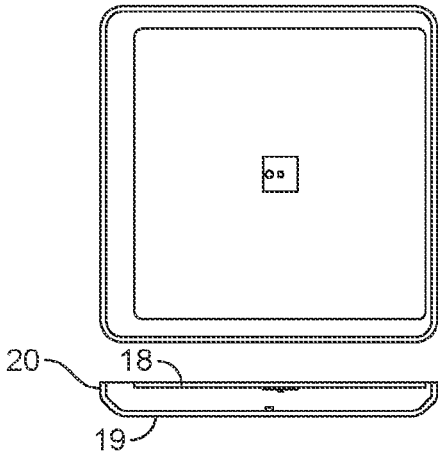
Figure 3C:
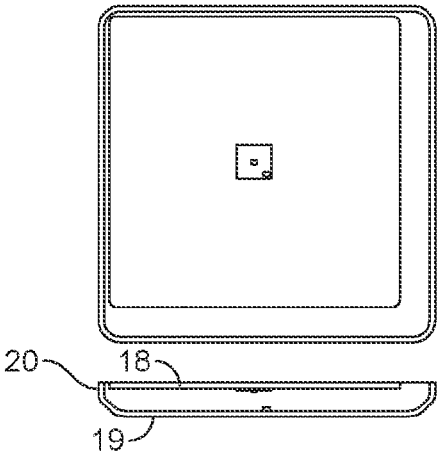
Figure 3D:
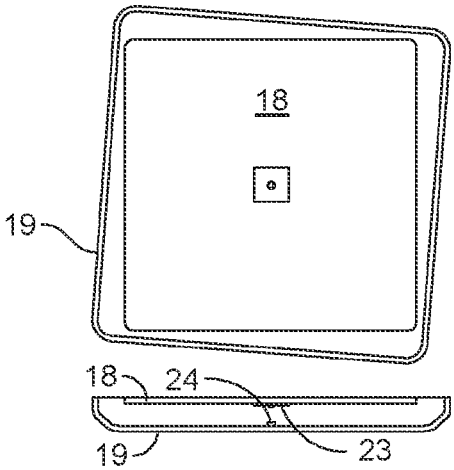

Referring now to FIGS. 3A to 3F, FIG. 3A shows the tray 19 in a central or un-deflected position with respect to the foot support 18. In this position, and in the absence of any other control limits, the motor 13 will respond to all inputs from the hand control 16. In FIG. 3B the carriage has encountered an obstacle while travelling in an uphill direction in FIG. 1 and the tray is displaced in the direction of arrow B. When the resultant signal generated by the Hall-effect sensor exceeds a threshold, the control unit 17 causes power to be cut to the motor 13 and the carriage to stop. In this situation, the control unit 17 may be programmed to allow the carriage to be driven in the downhill direction. In FIG. 3C an obstacle has been encountered while the stairlift is moving in a downhill direction, the obstacle being so sited as to cause the tray to be displaced both in the direction of arrow A and out of the plane of FIG. 1 i.e. along the (negative) y axis. In FIG. 3D the tray has encountered an obstacle causing it to rotate about its geometric centre.

Figure 3E:
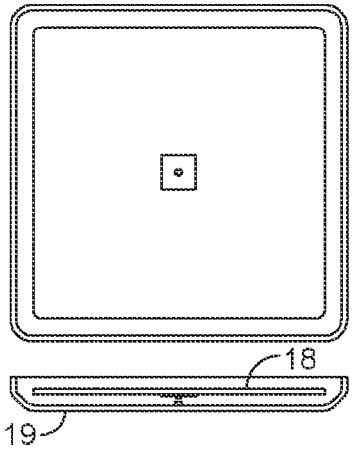
Figure 3F:
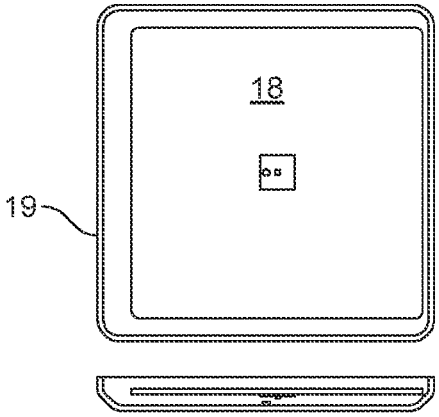

In FIG. 3E the tray is shown displaced vertically upward, in the direction of arrow C in FIG. 1, while in FIG. 3F that tray is displaced in the directions of both arrow C and arrow B.

In the case of all scenarios illustrated in FIGS. 3A to #3F, the movement of magnet 24 relative to Hall-effect sensor 23 causes the generation of a signal that is fed directly to the control unit 17 without the need for any switches and, if the signal exceeds a programmed threshold, a control signal is applied to the motor 7. The signal from the sensor 23 can also provide information as to the direction of displacement.

Those skilled in the art will appreciate that the any number of combinations of sensor and magnet could be used to detect safety pad movement, the invention not being confined to the detection of movement of a safety pad mounted on a footrest.

Figure 4A:
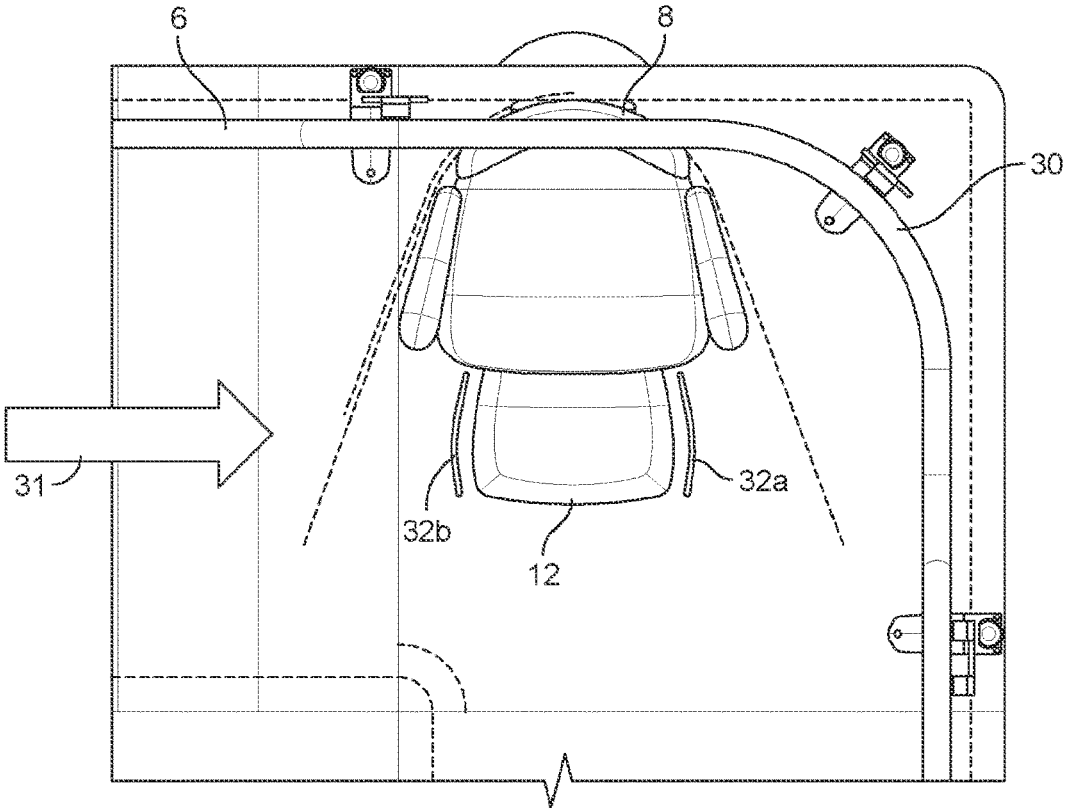
FIGS. 4A to 4C show a sequence of plan views of a stairlift moving through an outside bend.
Figure 4B:
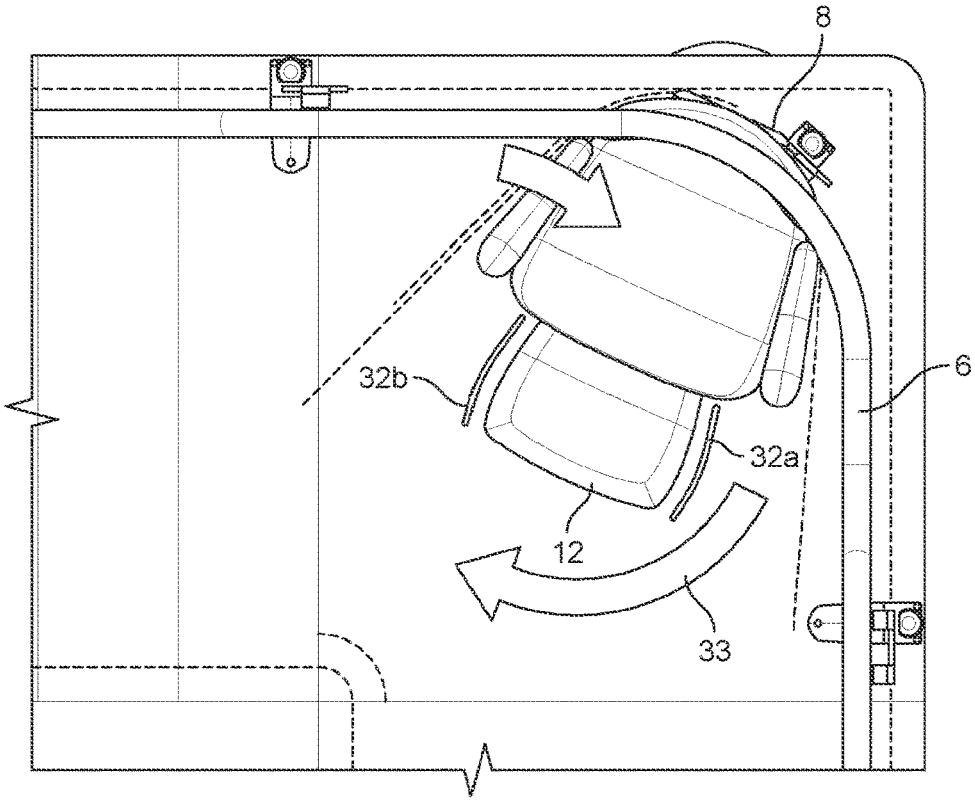
Figure 4C:
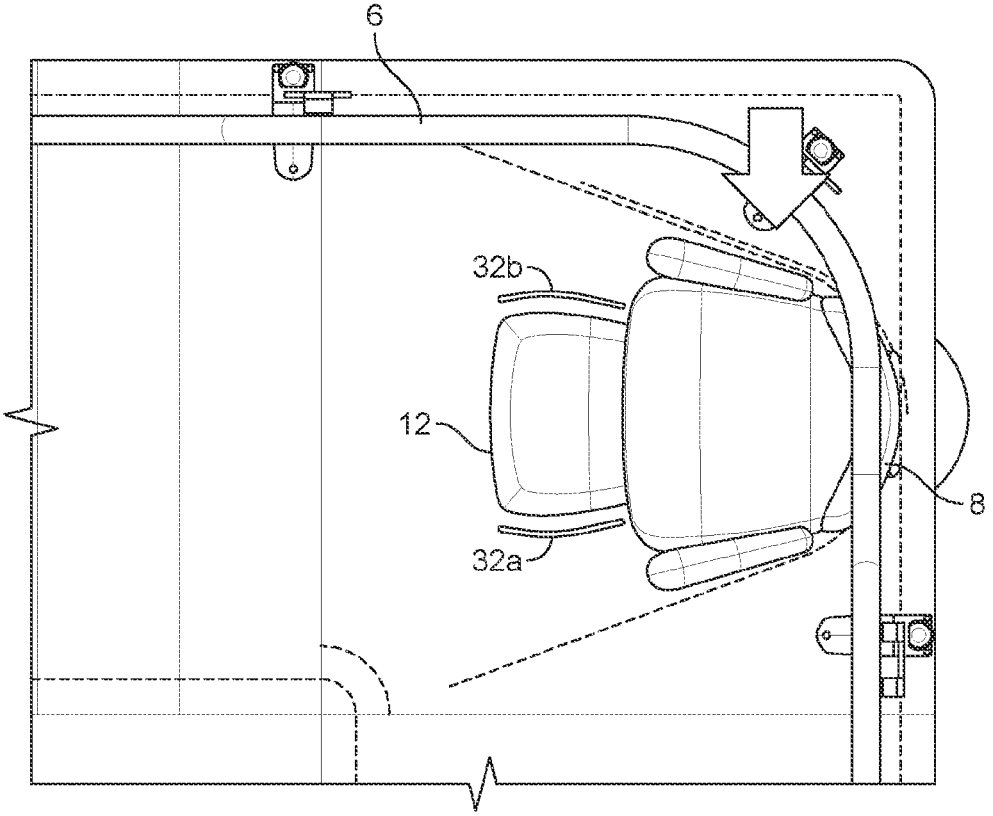

Turning now to FIGS. 4A to 4C, in another aspect the invention also provides the means of addressing a potential problem if the carriage encounters an obstruction when moving through an outside bend 30 in the direction of arrow 31 in FIG. 4A. In this particular example reference numeral 32*a* indicates a leading safety edge and reference numeral 32*b* indicates a trailing safety edge. The safety edges are shown located on opposite sides of the footrest 12 and, as stated above, could be separate components or could be defined by spaced edges on a common mount.

As the carriage begins moving through the bend 30 it is swivelled in the direction indicated by arrow 33 in FIG. 4B. During this movement the safety edge 32*b* effectively becomes the leading safety edge yet, because the overall direction of movement is that of arrow 31 in FIG. 4A, the control system will have de-activated safety edge 32*b* and thus displacement of the edge 32 will have no effect. The use of a electro-magnetic sensing system as described above provides a solution to this problem in that both displacement and direction of displacement are sensed so that if, while the carriage is moving through an outside bend as shown, an obstruction not encountered by edge 32*a* as the carriage enters the bend, is encountered by edge 32*b*, the carriage can be brought to a halt and subsequently 'backed off' the obstruction. In FIG. 4C, the carriage is exiting the bend 30 and safety edge 32*a* again assumes its status as the leading safety edge.

The above aspect of the invention requires a knowledge of the stairlift control system knowing when the carriage is entering an outside bend. This could be achieved using suitable switching devices mounted on the rail but could also be achieved by 'mapping' the rail substantially as described in our European Patent 0 738 232. Thus, when the control system determines that the carriage is entering an outside bend, the control system activates the trailing safety edge.

It will thus be appreciated that the invention, at least in the case of the working embodiment herein described, provides a novel and effective means of maintaining stairlift safety in case of all types of obstruction which could be encountered as a stairlift carriage moves up and down a stairlift rail.

The invention claimed is:

1. A stairlift comprising:
a carriage;
at least one safety edge mounted on said carriage but displaceable with respect to said carriage; and
a single programmable electro-magnetic facility configured to sense displacement of said safety edge relative to said carriage.

2. The stairlift according to as claimed in claim 1, wherein said at least one safety edge is incorporated in a footrest mounted on or forming part of said carriage.

3. The stairlift according to as claimed in claim 2, wherein a plurality of safety edges are provided on said footrest and wherein a single electromagnetic sensing facility is configured to sense displacement of each safety edge.

4. The stairlift according to as claimed in claim 3, wherein said plurality of safety edges are defined in or on a common member.

5. The stairlift as claimed in any one of the preceding claims according to claim 1, wherein said single programmable electro-magnetic facility is configured to determine direction of displacement of said safety edge relative to said carriage.

6. The stairlift chair footrest as claimed in any one of the preceding claims according to claim 1, wherein said single programmable electro-magnetic facility includes a Hall-effect sensor and a permanent magnet, the construction and arrangement being such that displacement of a safety edge effects relative displacement between said Hall-effect sensor and said magnet.

7. The stairlift as claimed in any one of the preceding claims according to claim 1, further including a drive motor and a control system, wherein said control system is configured to receive signals from said a single programmable electro-magnetic facility and, in response thereto, apply a control to said drive motor.

* * * * *